United States Patent [19]

de Stoutz

[11] 4,359,073

[45] Nov. 16, 1982

[54] MOBILE STATION FOR DISTRIBUTING BEVERAGES

[76] Inventor: William P. de Stoutz, Chateau de Larringes sur Evian, 74500 Evian, Haute Savoie, France

[21] Appl. No.: 171,181

[22] Filed: Jul. 22, 1980

[30] Foreign Application Priority Data

Aug. 13, 1979 [CH] Switzerland ..... 7393/79

[51] Int. Cl.[3] ..... B65B 3/04; B67C 1/00

[52] U.S. Cl. ..... 141/89; 134/55; 141/231; 222/608; 296/22

[58] Field of Search ..... 137/344; 141/1, 89, 141/91, 92, 231; 134/44, 54, 55; 222/108, 135, 136, 608; 280/5 R, 5 D; 296/21, 22

[56] References Cited

U.S. PATENT DOCUMENTS 2,294,668 9/1942 Karas ..... 134/55

2,733,094 1/1956 Carlton ..... 296/22

4,225,059 9/1980 Kappos ..... 222/608 X

*Primary Examiner*—Frederick R. Schmidt

*Attorney, Agent, or Firm*—Young & Thompson

[57] ABSTRACT

A mobile station for the distribution of beverages is mounted on a truck and comprises two reservoirs for beverages and a reservoir for sterilized water. Automatic distributors are fed by the beverage reservoir; while the water reservoir feeds apparatus for washing and sterilizing the cups. A drawer stores the cups in stacked relation. Troughs beneath the automatic distributors and below the apparatus for washing and sterilizing cups, catch the liquids that would otherwise fall to the ground and return them to a recovery vessel from which the liquids may be drained. Vertically swinging canopies protect the equipment in transit and, when swung up, serve as awnings for the users.

6 Claims, 7 Drawing Figures

MOBILE STATION FOR DISTRIBUTING BEVERAGES

The sale or distribution of beverages is now conducted either at fixed points of sale or distribution by retail sales or automatic distributors, or as the case may be at other nonpermanent points of distribution for the sale of bottled beverages.

These modes of distribution or sale have serious drawbacks, among them being the fixity of the place of sale, the need for using disposable containers or the recycling of containers, the filling and cleaning of automatic distributors at spaced locations, etc.

The present invention has for its object the provision of a mobile station for the distribution of beverages which permits, particularly for certain types of distribution such as the distribution of milk in schools or beverages at sporting events or the like, a distribution which is rapid, efficient and economical.

This mobile distribution station for beverages is distinguished by the fact that it comprises an automotive vehicle carrying at least two reservoirs, provided with automatic cleaning systems, for receiving beverages to be distributed as well as a reservoir for sterilized water. Each beverage reservoir is connected to several distributors which dispense at each actuation a predetermined quantity of beverage. A trough is located below the beverage distributors, connected to a recovery vessel. The sterilized water reservoir feeds at least one spraying and sterilizing device for a receptacle that has contained the beverage; and a trough located under the spraying device is connected to the recovery vessel collecting the water used for sterilizing the receptacle.

In the accompanying drawings, which show schematically by way of example an embodiment of the mobile station for distributing beverages according to the invention:

Figure 1:
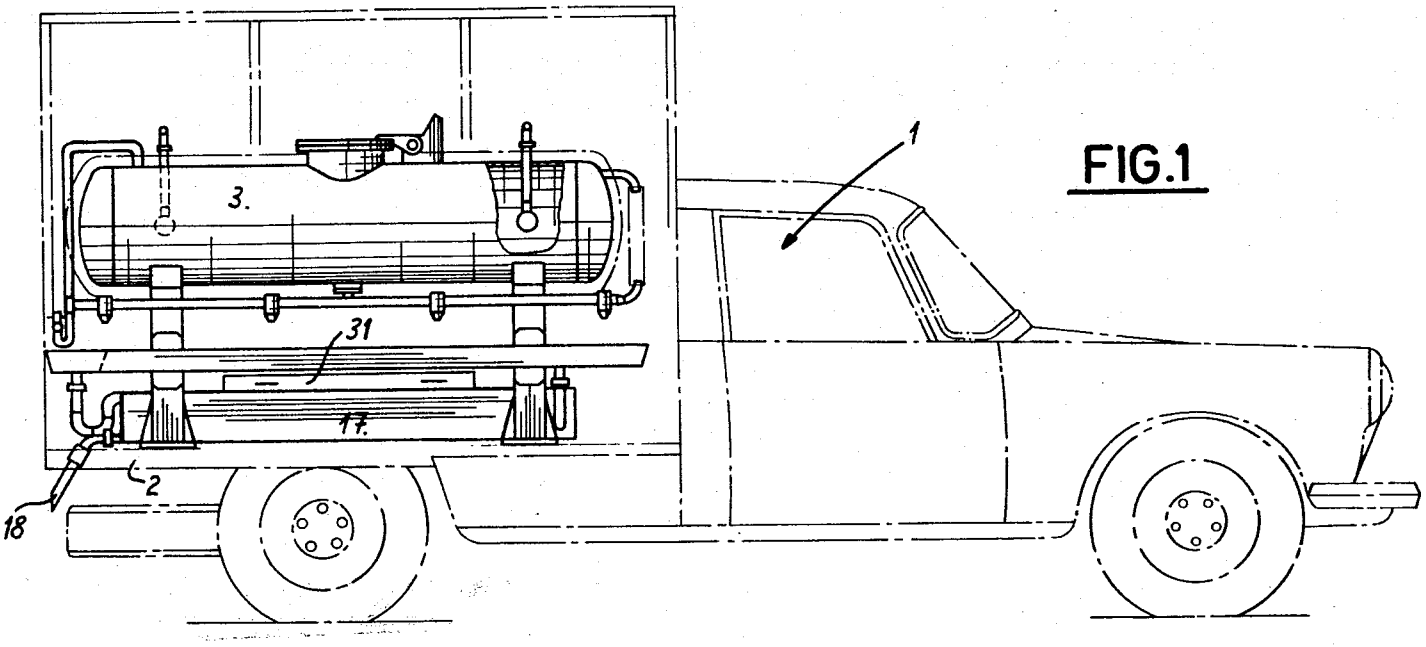
FIG. 1 is a general side view of the mobile station.
Figure 2:
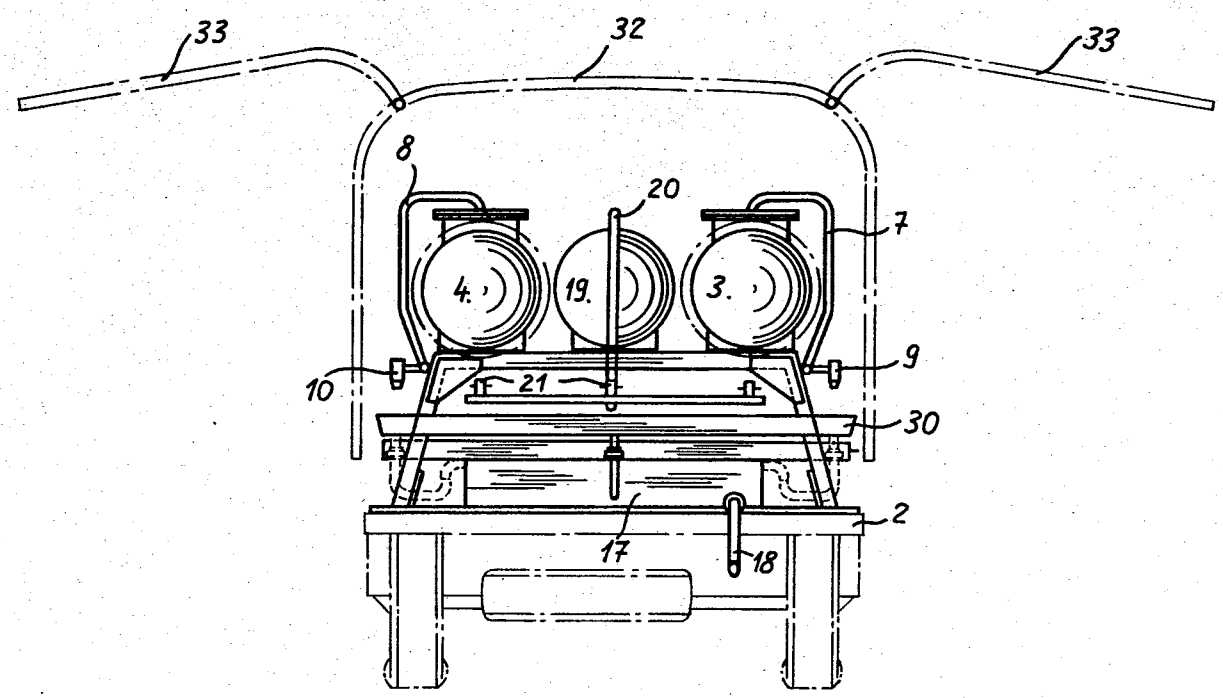
FIG. 2 is a rear view thereof.
Figure 3:
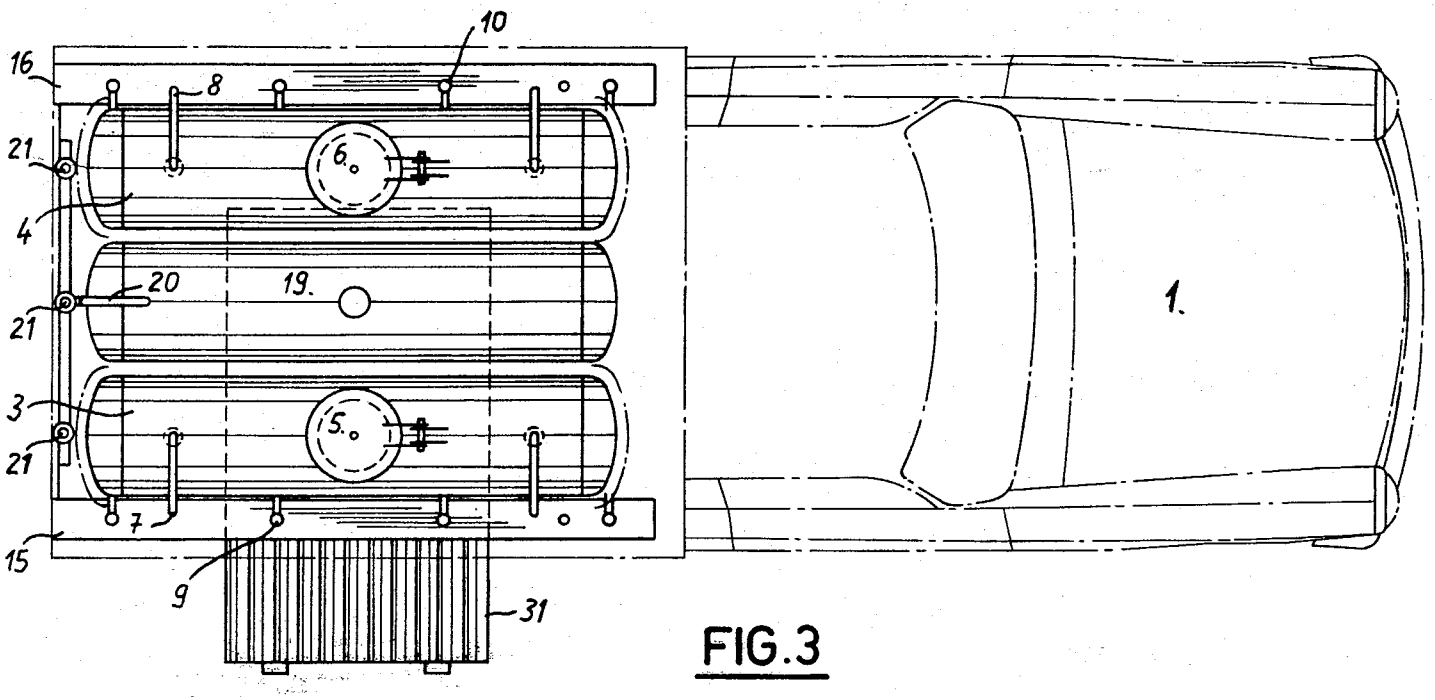
FIG. 3 is a top plan view thereof.

The mobile station for distributing beverages, particularly fresh milk, shown in FIGS. 1 to 3 is intended to permit rapid distribution of a large number of servings of pasteurized milk to ensure milk distribution to students under the best conditions.

This mobile station comprises an automotive vehicle, shown as a truck 1, whose bed 2 carries the station's storage and distribution equipment. This equipment comprises two reservoirs 3, 4 of about 100 gallons each for receiving the milk or beverages to be distributed. These reservoirs 3, 4 are provided with manholes, 5, 6 and known automatic cleaning equipment.

Figure 4:
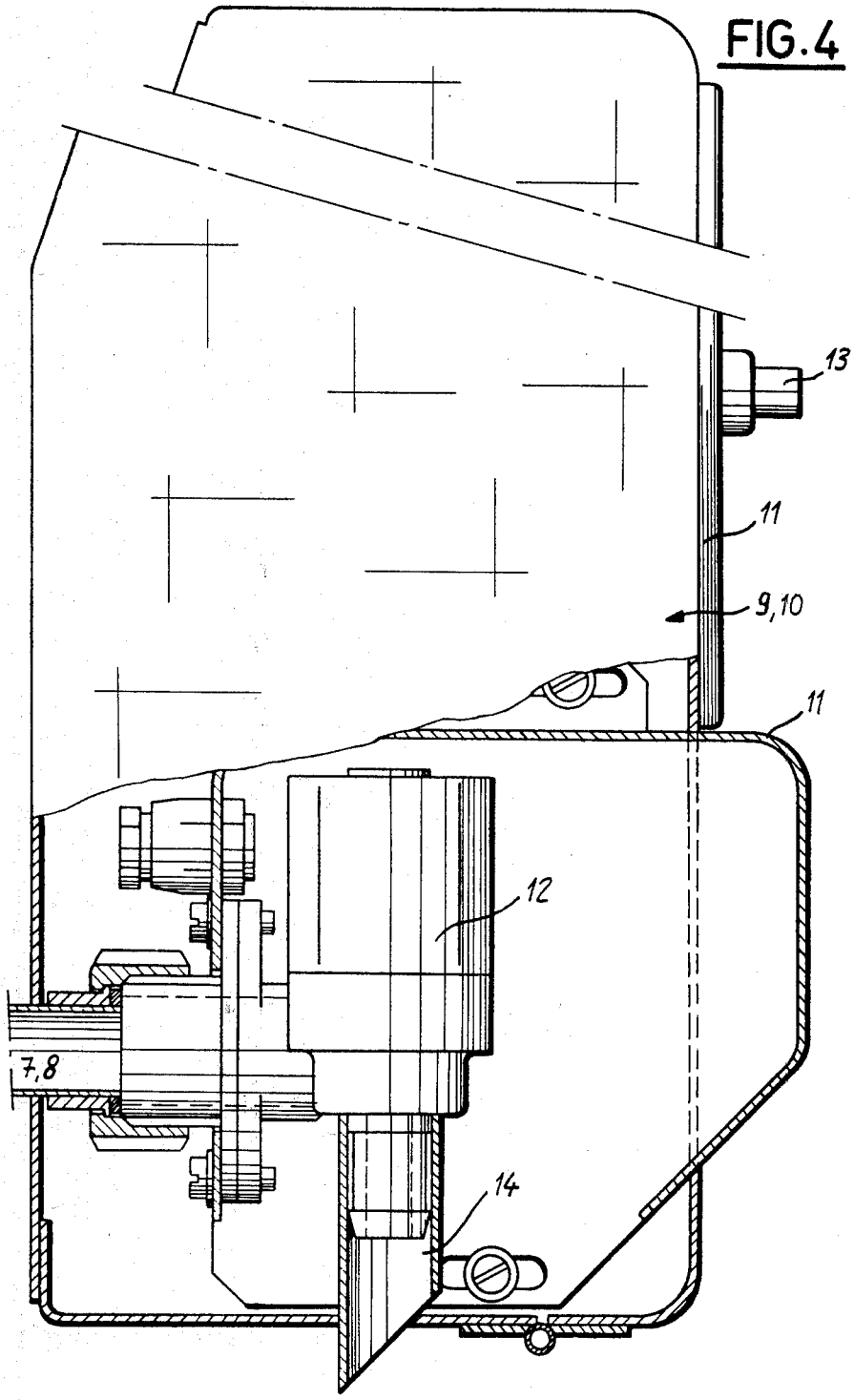
FIG. 4 shows on a larger scale a beverage dispenser partly in section.

Each reservoir 3, 4 feeds by a conduit 7, 8 distributors 9, 10 delivering at each actuation a predetermined quantity of liquid. These distributors 9, 10 shown in detail in FIG. 4 comprise inside a casing 11 an electromagnetic valve 12 fed by conduit 7, 8 and controlled by an electrical control circuit (not shown) actuated by pushbutton 13. For each pressure on button 13, the electromagnetic valve 12 is opened for a predetermined, preadjustable time, so as to deliver a predetermined quantity of liquid through conduit 14.

The pouring conduits 14 of the distributors 9, 10 are located above a recovery trough 15, 16 respectively to recover the liquid flowing from conduits 14 when there is no receptacle below this conduit 14. These troughs are connected to a recovery vessel 17 located below the reservoirs 3, 4. This recovery vessel may be emptied by a conduit 18.

In a modification (not shown), it is evident that the distributors 9, 10 may be provided with an unlocking device for prepayment when the beverage distribution is paid for.

Between the two beverage reservoirs 3, 4 is located a reservoir 19 for sterilized water feeding by a conduit 20 spraying and sterilizing devices 21 for the receptacles used to contain the beverages.

Figure 5:
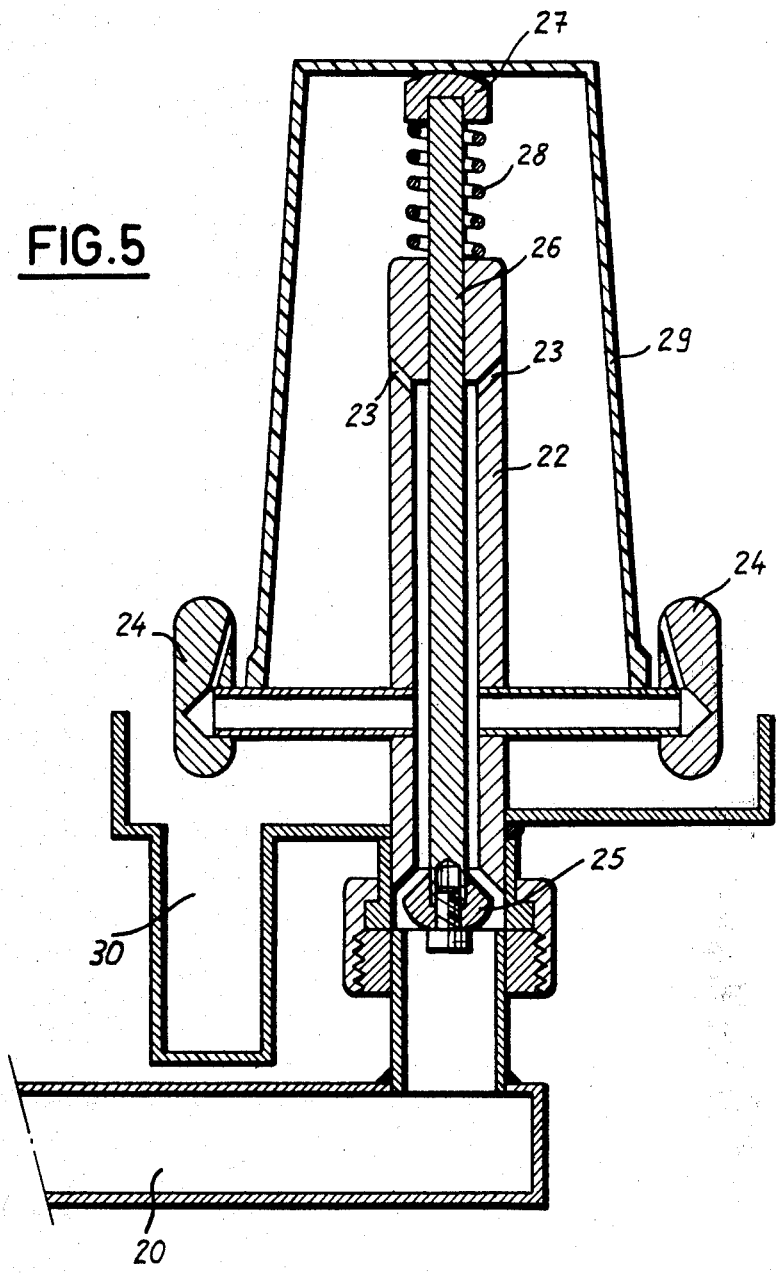
FIG. 5 shows on a larger scale a cross-sectional view of a spraying and sterilizing device for the receptacles.

Each spraying and sterilizing device, shown in detail in FIG. 5, comprises a central nozzle 22 provided with several angularly spaced spray passages 23 and several lateral nozzles 24 connected to the central nozzle 22.

A valve 25 closes the feed channel 20 for sterilized water under pressure. This valve is fixed to a rod 26 passing through the principal nozzle and terminating in a pusher 27 subjected to the action of a spring 28 tending to close the valve 25.

Thus, when one places a cup 29 inverted on the principal central nozzle 22 and pushes, the valve 25 is opened and the cup is sprayed with sterilized water under pressure not only inside but also outside. Thus, the cup is washed and sterilized.

A recovery trough 30 recovers the used water and returns it to the recovery vessel 17.

The distribution equipment comprises also a divided drawer 31 for holding a supply of cups.

A protector 32, which is part of the body of truck 1, protects the distribution equipment and comprises swinging sides 33. In the lowered, closed position, these sides protect the distribution installation during transport while in the raised position they comprise protective awnings for users who are operating the distributors 9, 10.

The beverage reservoirs 3, 4 may be pressurized with a protective gas, for example nitrogen or carbon dioxide. In this case, the reservoirs are accordingly hermetically sealed, and all introduction of external air is thus avoided during the drawing of beverages. This is very important on the one hand to prevent contamination of the stored beverages by the external environment and on the other hand for the best preservation of beverages that are sensitive to the oxygen in the air.

It is evident that the beverage reservoirs 3, 4 may also be provided with heating or cooling or thermal insulation means so as to be able to distribute hot or refrigerated beverages.

Figure 7:
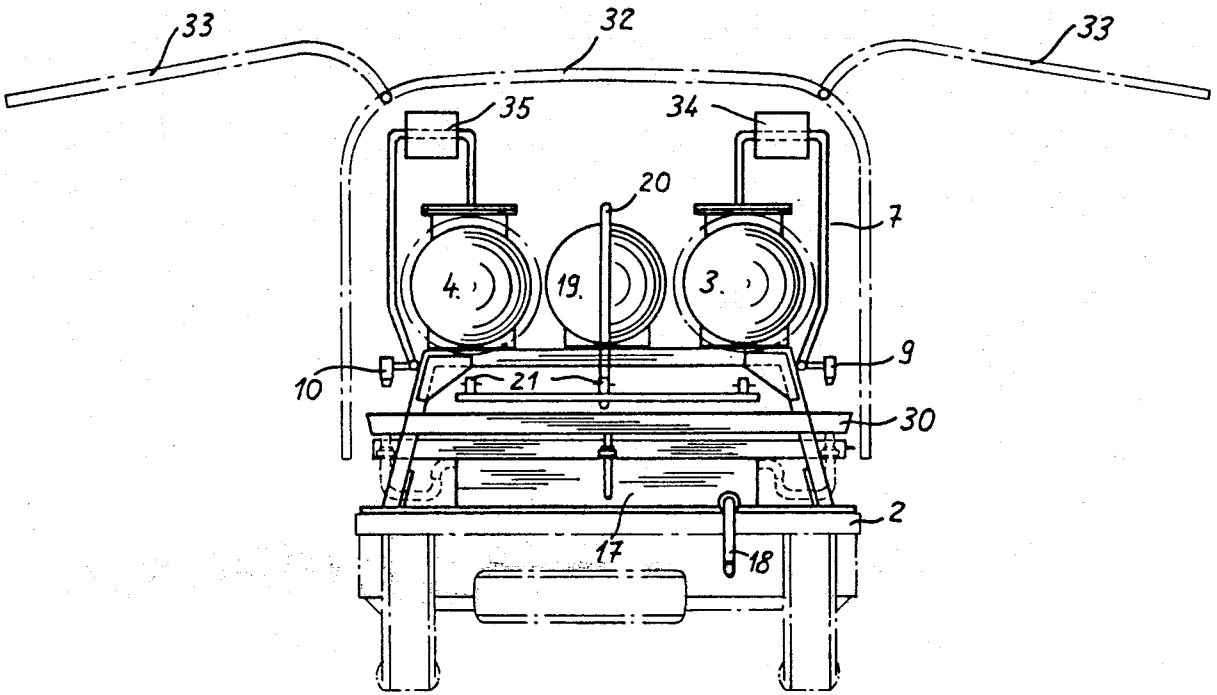

FIG. 7 shows a mobile station in which the outlet duct 7 of reservoir 3 is equipped with a heating device 34 which can be comprised by electric resistive heating means supplied with DC current from the engine or battery of the vehicle.

In the station of FIG. 7 the outlet duct of reservoir 4 is equipped with cooling means 35 having for example a heat exchanger, one circuit of which is provided for the beverage and the other one being fed with a cooling medium such as liquefied Freon, means being also provided to cool and liquefy the evaporated Freon, as in a known refrigeration circuit for example.

Moreover, according to a non-illustrated modification, the sterilized water reservoir 19 may also feed by conduits connecting it to beverage reservoirs 3, 4 apparatus for rinsing the inside walls of these reservoirs.

Figure 6:
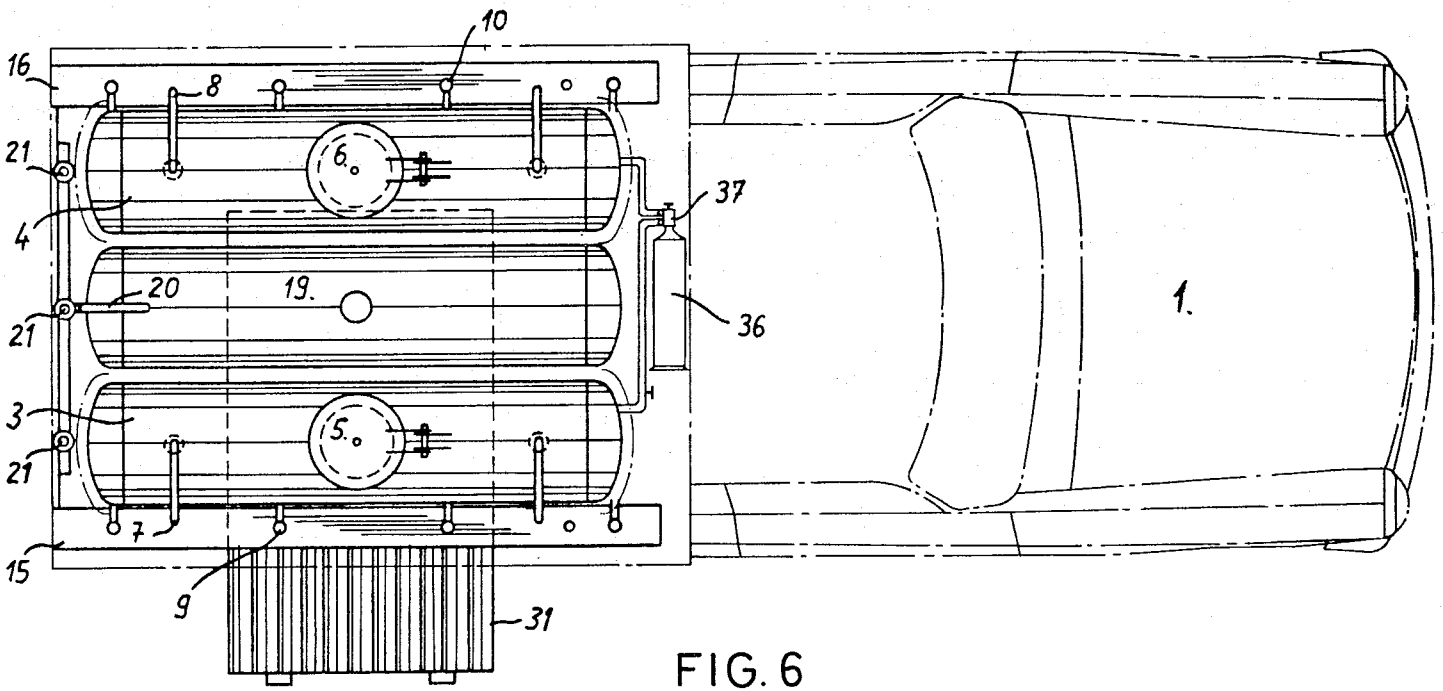
FIGS. 6 and 7 show variants of the mobile station.

In FIG. 6 a mobile station is illustrated which comprises means to pressurize the inside of the reservoirs 3, 4 with an inert gas. Therefore a bottle of pressurized inert gas 36 is provided and connected to the upper part of reservoirs 3, 4 through a valve and pressure reduction member 37. The beverages are thus not in contact with air even when part of the liquid has been distributed and therefore no oxidation of the beverage can occur.

This mobile distribution station is extremely advantageous because it permits distributing one or more beverages simultaneously, hot or cold, free or paid for. Such a mobile station may make a circuit of the schools during recess or be parked during a celebration or a sporting event at a stadium or other location.

A totalizing counter (not shown) may be provided for counting and displaying the total number of servings dispensed.

Thanks to the cup sterilizing means, these can be reused which represents a large saving and a substantial reduction of costs for example during meetings or sporting events.

Thanks to the fact that the beverages are stored in bulk, the frequently high cost of their packaging is saved and also there is a great reduction in the trash that results from disposable containers that are generally used.

The distribution capacity of such a station is very large, such that about 15,000 to 20,000 half-pint servings can be distributed per day.

Finally, the automatic washing and filling of the reservoirs can proceed very rapidly.

From a consideration of the foregoing disclosure, therefore, it will be evident that the initially recited object of the invention has been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention, as defined by the appended claims.

What is claimed is:

1. Mobile station for distributing beverages, comprising a self-propelled automotive vehicle carrying at least two reservoirs to receive at least one beverage to be distributed, a sterilized water reservoir, said at least two beverage reservoirs being each connected to several distributors dispensing at each actuation a predetermined quantity of beverage, a first trough located below the beverage distributors, connected to a recovery vessel, the sterilized water reservoir feeding at least one spraying and sterilizing device for a receptacle which has contained the beverage, and a second trough located under the spraying device and connected to the same said recovery vessel as said first trough.

2. Station according to claim 1, and a drawer the mobile station containing stackable receptacles.

3. Station according to claim 2, in which the distributors are money operated.

4. Station according to 1 and protection means surrounding the reservoirs and distributors in the transport position and providing awnings in the service position for protecting the users.

5. Station according to 1, and means for heating or refrigerating the beverages to be distributed.

6. Station according to 1, in which at least one of the beverage reservoirs is pressurized with a protective gas.

* * * * *